US007891131B2

(12) United States Patent
Holmberg

(10) Patent No.: US 7,891,131 B2
(45) Date of Patent: Feb. 22, 2011

(54) DEVICE MOUNT SYSTEM FOR A WEAPON

(76) Inventor: Larry Holmberg, P.O. Box 63, Wascott, WI (US) 54890

( * ) Notice: Subject to any disclaimer, the term of this patent is extended or adjusted under 35 U.S.C. 154(b) by 738 days.

(21) Appl. No.: 11/620,486

(22) Filed: Jan. 5, 2007

(65) Prior Publication Data

US 2008/0164392 A1 Jul. 10, 2008

(51) Int. Cl.
*F41G 1/38* (2006.01)

(52) U.S. Cl. ..... 42/124; 42/146; 33/266; 248/299.15; 248/316.6

(58) Field of Classification Search ..... 248/214, 248/222.14, 229.22, 229.25, 229.14, 229.15, 248/230.5, 230.6, 315, 316.6; 42/124, 125, 42/142, 146; 33/266
See application file for complete search history.

(56) References Cited

U.S. PATENT DOCUMENTS

| | | | | |
|---|---|---|---|---|
| 521,761 | A | 6/1894 | Day | |
| 547,912 | A | 10/1895 | Crupe | |
| 619,214 | A | 2/1899 | Paul | |
| 674,229 | A | 5/1901 | Windle | |
| 845,165 | A | 2/1907 | Davis | |
| 899,639 | A | 9/1908 | Vibber | |
| 1,452,651 | A * | 4/1923 | Norrlin | 362/110 |
| 1,480,147 | A | 1/1924 | Fokko | |
| 2,101,479 | A | 12/1937 | Schenk | |
| 2,450,466 | A | 10/1948 | Carlson | |
| 2,814,118 | A | 11/1957 | Evans et al. | |
| 3,427,102 | A | 2/1969 | Wade | |
| 3,483,623 | A | 12/1969 | Kruzell | |
| 3,684,376 | A | 8/1972 | Lessard | |
| 3,684,378 | A | 8/1972 | Lord | |
| 3,737,232 | A | 6/1973 | Milburn, Jr. | |
| 3,782,822 | A | 1/1974 | Spence | |

(Continued)

FOREIGN PATENT DOCUMENTS

EP 1804017 A1 7/2007

(Continued)

OTHER PUBLICATIONS

Improved Construction Methods, "Laser Measuring System, Impulse LX", http://www.improvedconstructionmethods.com/impulse_xl.htm.

(Continued)

*Primary Examiner*—A. Joseph Wujciak, III
(74) *Attorney, Agent, or Firm*—Kinney & Lange, P.A.

(57) ABSTRACT

An attaching system for mounting a device to a weapon is provided. The attaching system includes an attaching ring, a mounting rail and a threaded attaching member. The attaching ring includes a weapon attaching portion, a retaining portion and an extending portion. The weapon attaching portion is configured to attach to a weapon. The retaining portion is configured to receive and hold a mounting rail. The retaining portion includes a retaining aperture. The extended portion is coupled between the weapon attaching portion and the retaining portion. The extending portion has a select length to space the weapon attaching portion from the retaining portion a select distance. The mounting rail is configured to be received in the retaining portion. The mounting rail has a threaded recess. The threaded attaching member is configured to pass through the retaining aperture and to threadably engage the threaded recess of the mounting rail.

11 Claims, 3 Drawing Sheets

U.S. PATENT DOCUMENTS

| | | | | |
|---|---|---|---|---|
| 3,785,261 | A | 1/1974 | Ganteaume | |
| 3,834,052 | A | 9/1974 | Steck, III | |
| 4,000,403 | A * | 12/1976 | Rice | 362/370 |
| 4,026,054 | A * | 5/1977 | Snyder | 42/115 |
| 4,027,414 | A | 6/1977 | Felix | |
| 4,069,414 | A * | 1/1978 | Bell | 362/110 |
| 4,223,770 | A | 9/1980 | Kranz | |
| 4,233,770 | A | 11/1980 | de Filippis et al. | |
| 4,283,743 | A | 8/1981 | Kaiser | |
| T101,001 | I4 | 9/1981 | Shipp et al. | |
| 4,296,725 | A | 10/1981 | Broderick | |
| D268,910 | S | 5/1983 | Shipp et al. | |
| 4,514,907 | A | 5/1985 | Saltzman | |
| 4,516,296 | A | 5/1985 | Sherman | |
| 4,531,052 | A | 7/1985 | Moore | |
| 4,561,204 | A | 12/1985 | Binion | |
| 4,564,322 | A | 1/1986 | Stapley | |
| 4,597,211 | A | 7/1986 | Miles | |
| 4,606,629 | A | 8/1986 | Hines et al. | |
| 4,617,741 | A | 10/1986 | Bordeaux et al. | |
| 4,640,258 | A | 2/1987 | Penney et al. | |
| 4,643,159 | A | 2/1987 | Ryan | |
| 4,730,190 | A | 3/1988 | Win et al. | |
| 4,753,528 | A | 6/1988 | Hines et al. | |
| 4,777,352 | A | 10/1988 | Moore | |
| 4,786,204 | A | 11/1988 | Mayeda | |
| 4,786,966 | A | 11/1988 | Hanson et al. | |
| 4,827,348 | A | 5/1989 | Ernest et al. | |
| 4,835,621 | A | 5/1989 | Black | |
| 4,884,137 | A | 11/1989 | Hanson et al. | |
| 4,890,128 | A | 12/1989 | Kania | |
| 4,910,717 | A | 3/1990 | Terry | |
| 4,939,863 | A | 7/1990 | Alexander et al. | |
| 4,970,589 | A | 11/1990 | Hanson et al. | |
| 4,974,575 | A | 12/1990 | Mitchell | |
| D313,361 | S | 1/1991 | Robinson | |
| 4,993,833 | A | 2/1991 | Lorey et al. | |
| 4,996,866 | A | 3/1991 | Masera et al. | |
| 5,005,213 | A | 4/1991 | Hanson et al. | |
| 5,020,262 | A | 6/1991 | Pena | |
| 5,026,158 | A | 6/1991 | Golubic | |
| 5,033,219 | A | 7/1991 | Johnson et al. | |
| 5,161,310 | A | 11/1992 | Stoot | |
| 5,200,827 | A | 4/1993 | Hanson et al. | |
| 5,262,837 | A | 11/1993 | Shyy | |
| 5,265,896 | A | 11/1993 | Kravitz | |
| 5,297,533 | A | 3/1994 | Cook | |
| 5,326,061 | A | 7/1994 | Hamilton | |
| 5,339,793 | A | 8/1994 | Findley | |
| 5,373,657 | A | 12/1994 | Betz et al. | |
| 5,418,609 | A | 5/1995 | Dunne | |
| 5,455,625 | A | 10/1995 | Englander | |
| 5,456,157 | A | 10/1995 | Lougheed et al. | |
| 5,479,712 | A | 1/1996 | Hargrove et al. | |
| 5,507,272 | A | 4/1996 | Scantlen | |
| 5,520,164 | A | 5/1996 | Huddleston | |
| D371,084 | S | 6/1996 | Ogawa | |
| 5,531,149 | A | 7/1996 | Schubert et al. | |
| 5,555,665 | A | 9/1996 | Fore | |
| 5,575,072 | A | 11/1996 | Eldridge | |
| 5,606,818 | A | 3/1997 | Hardee | |
| 5,611,324 | A | 3/1997 | Kursinsky | |
| 5,669,147 | A | 9/1997 | Nakajima et al. | |
| 5,669,174 | A | 9/1997 | Teetzel | |
| 5,686,690 | A | 11/1997 | Lougheed et al. | |
| 5,687,910 | A | 11/1997 | King | |
| 5,711,104 | A | 1/1998 | Schmitz | |
| D390,483 | S | 2/1998 | Zykan et al. | |
| 5,739,859 | A | 4/1998 | Hattori et al. | |
| 5,815,251 | A | 9/1998 | Ehbets et al. | |
| 5,822,621 | A | 10/1998 | Szajewski | |
| 5,831,718 | A | 11/1998 | Desai et al. | |
| 5,834,676 | A | 11/1998 | Elliott | |
| 5,845,165 | A | 12/1998 | McMahan | |
| 5,859,693 | A | 1/1999 | Dunne et al. | |
| 5,887,375 | A | 3/1999 | Watson | |
| 5,892,617 | A | 4/1999 | Wallace | |
| 5,895,131 | A | 4/1999 | Yano | |
| 5,911,215 | A | 6/1999 | Fisher, Jr. | |
| 5,926,260 | A | 7/1999 | Dunne et al. | |
| 5,937,562 | A | 8/1999 | Brough | |
| 5,944,041 | A | 8/1999 | Kitchens | |
| 5,949,529 | A | 9/1999 | Dunne et al. | |
| 5,964,054 | A | 10/1999 | Galfidi, Jr. | |
| 5,973,315 | A | 10/1999 | Saldana et al. | |
| D421,229 | S | 2/2000 | Imai | |
| 6,029,643 | A | 2/2000 | Golfieri | |
| 6,070,355 | A | 6/2000 | Day | |
| 6,073,352 | A | 6/2000 | Zykan et al. | |
| D432,930 | S | 10/2000 | Sanoner | |
| 6,137,564 | A | 10/2000 | Schmidt et al. | |
| 6,154,971 | A | 12/2000 | Perkins | |
| 6,192,614 | B1 | 2/2001 | Cliburn | |
| 6,252,706 | B1 | 6/2001 | Kaladgew | |
| 6,269,581 | B1 | 8/2001 | Groh | |
| D448,315 | S | 9/2001 | Ito | |
| 6,286,796 | B1 | 9/2001 | Pugliesi | |
| 6,288,386 | B1 | 9/2001 | Bowen et al. | |
| 6,296,581 | B1 | 10/2001 | Sever | |
| 6,304,289 | B1 | 10/2001 | Sakai et al. | |
| 6,331,887 | B1 | 12/2001 | Shiraishi et al. | |
| 6,336,285 | B1 | 1/2002 | Baumer | |
| 6,341,201 | B1 | 1/2002 | Ishiguro et al. | |
| 6,396,571 | B2 | 5/2002 | Ohtomo et al. | |
| 6,397,483 | B1 | 6/2002 | Perkins | |
| 6,398,571 | B1 | 6/2002 | Nishide et al. | |
| 6,408,140 | B1 | 6/2002 | Malloy Desormeaux | |
| D460,367 | S | 7/2002 | Apotheloz et al. | |
| D460,368 | S | 7/2002 | Apotheloz et al. | |
| D460,369 | S | 7/2002 | Apotheloz et al. | |
| 6,425,697 | B1 | 7/2002 | Potts et al. | |
| 6,450,816 | B1 | 9/2002 | Gerber | |
| 6,487,809 | B1 | 12/2002 | Gaber | |
| 6,494,196 | B2 | 12/2002 | Harwath et al. | |
| 6,526,956 | B1 | 3/2003 | Hankins | |
| D472,826 | S | 4/2003 | Sanoner | |
| 6,556,245 | B1 | 4/2003 | Holmberg | |
| 6,598,331 | B1 * | 7/2003 | Thibodeaux | 42/111 |
| 6,615,531 | B1 | 9/2003 | Holmberg | |
| 6,623,182 | B2 | 9/2003 | Tatera | |
| 6,624,881 | B2 | 9/2003 | Waibel et al. | |
| 6,678,988 | B1 | 1/2004 | Poff, Jr. | |
| 6,681,755 | B2 | 1/2004 | Pujos | |
| 6,693,702 | B2 | 2/2004 | Rogers | |
| 6,704,097 | B2 | 3/2004 | Waibel et al. | |
| D488,315 | S | 4/2004 | Natuzzi | |
| 6,722,076 | B2 | 4/2004 | Nielsen | |
| 6,742,299 | B2 | 6/2004 | Strand | |
| 6,772,076 | B2 | 8/2004 | Yamamoto et al. | |
| 6,784,920 | B2 | 8/2004 | Weber | |
| 6,796,038 | B2 | 9/2004 | Humphries | |
| 6,813,025 | B2 | 11/2004 | Edwards | |
| 6,815,251 | B1 | 11/2004 | Akram et al. | |
| 6,819,495 | B2 | 11/2004 | Shani et al. | |
| 6,819,866 | B2 | 11/2004 | Da Silva | |
| 6,886,287 | B1 | 5/2005 | Bell et al. | |
| 6,886,288 | B1 | 5/2005 | Yocum et al. | |
| 6,932,305 | B2 | 8/2005 | Morales et al. | |
| 6,988,331 | B2 | 1/2006 | Holmberg | |
| 7,006,144 | B2 | 2/2006 | Holmberg | |
| 7,088,506 | B2 | 8/2006 | Regan et al. | |
| 7,128,354 | B2 | 10/2006 | Wu | |
| 7,269,920 | B2 | 9/2007 | Staley, III | |
| 7,390,130 | B2 | 6/2008 | Soulvie | |

| | | | |
|---|---|---|---|
| 2002/0067475 | A1 | 6/2002 | Waibel et al. |
| 2002/0078577 | A1 | 6/2002 | Aldred |
| 2002/0087475 | A1 | 7/2002 | Okayama et al. |
| 2002/0109057 | A1 | 8/2002 | Wooten et al. |
| 2002/0171755 | A1 | 11/2002 | Nishimura |
| 2003/0013392 | A1 | 1/2003 | Guillermin |
| 2003/0133092 | A1 | 7/2003 | Rogers |
| 2003/0163943 | A1 | 9/2003 | Holmberg |
| 2004/0000083 | A1 | 1/2004 | Grant, Jr. |
| 2004/0016169 | A1 | 1/2004 | Poff, Jr. |
| 2004/0051865 | A1 | 3/2004 | Stierle et al. |
| 2004/0079018 | A1 | 4/2004 | Holmberg |
| 2004/0114129 | A1 | 6/2004 | Gogolla et al. |
| 2004/0135991 | A1 | 7/2004 | Gogolla et al. |
| 2004/0183942 | A1 | 9/2004 | Holmberg |
| 2004/0194364 | A1 | 10/2004 | Holmberg |
| 2004/0257437 | A1 | 12/2004 | Lesseu |
| 2005/0035245 | A1 | 2/2005 | Morales et al. |
| 2005/0123883 | A1 | 6/2005 | Kennen et al. |
| 2005/0195385 | A1 | 9/2005 | Holmberg |
| 2005/0241210 | A1 | 11/2005 | Karcher et al. |
| 2005/0246910 | A1 | 11/2005 | Mowers |
| 2005/0252062 | A1 | 11/2005 | Scrogin et al. |
| 2005/0268519 | A1 | 12/2005 | Pikielny |
| 2005/0268521 | A1 | 12/2005 | Cox et al. |
| 2006/0010761 | A1 | 1/2006 | Staley, III |
| 2006/0215149 | A1 | 9/2006 | LaBelle et al. |
| 2007/0008187 | A1 | 1/2007 | Schmidt |
| 2007/0031142 | A1 | 2/2007 | Moody et al. |
| 2007/0068018 | A1 | 3/2007 | Gilmore |
| 2007/0081817 | A1 | 4/2007 | Soulvie |
| 2007/0157502 | A1 | 7/2007 | Holmberg |
| 2007/0157503 | A1 | 7/2007 | Holmberg |
| 2007/0277421 | A1 | 12/2007 | Perkins |
| 2008/0000465 | A1 | 1/2008 | Holmberg |
| 2008/0060248 | A1 | 3/2008 | Pine et al. |

FOREIGN PATENT DOCUMENTS

| | | | |
|---|---|---|---|
| GB | 2024558 | | 1/1980 |
| GB | 2024558 | A | 1/1980 |
| GB | 2114770 | | 8/1983 |
| GB | 2114770 | A | 8/1983 |
| WO | 9012330 | | 10/1990 |
| WO | WO9012330 | | 10/1990 |
| WO | 2006090356 | A1 | 8/2006 |
| WO | WO2006090356 | A1 | 8/2006 |
| WO | WO2006133029 | A2 | 12/2006 |

OTHER PUBLICATIONS

"Specification Sheet on the Impulse 200 LR Laser (Rangefinder)", Nov. 15, 2003, Publisher: Laser Technology, Inc.

* cited by examiner

DEVICE MOUNT SYSTEM FOR A WEAPON

RELATED APPLICATIONS

The present application is related to the commonly owned application having Ser. No. 11/550,127 (the '127 application) filed on Oct. 17, 2006 entitled "Device Mount with Stabilizing Function." The '127 application is incorporated in its entirety by reference in this application.

BACKGROUND

For game hunters the ability to record the hunt in an efficient manner is desired. Moreover, the ability to attach other devices such as cameras and other electronic devices to a weapon used in the hunt in a manner that does not impede the hunt is also desired. For the reasons stated above and for other reasons stated below which will become apparent to those skilled in the art upon reading and understanding the present specification, there is a need in the art for an attaching system that can attach a device such an electronic device to a weapon in an effective and un-intrusive manner.

SUMMARY OF THE INVENTION

The above-mentioned problems of current systems are addressed by embodiments of the present invention and will be understood by reading and studying the following specification. The following summaries are provided as way of examples and not by way of limitation. Moreover, the summaries may include more or less elements than are in the claims and are merely provided to give the reader a basic understanding of some of the elements of the present invention.

In one embodiment an attaching ring is provided. The attaching ring includes a weapon attaching portion, a retaining portion and an extended portion. The weapon attaching portion is configured to attach to a weapon. The retaining portion is configured to receive and hold a mounting rail. Moreover, the extended portion is coupled between the weapon attaching portion and the retaining portion. The extending portion has a select length to space the weapon attaching portion from the retaining portion a select distance.

In another embodiment, another attaching ring is provided, the attaching ring includes a main attaching portion and a second attaching portion. The main attaching portion has a first half circle near a first end and a receiving rail recess near a second end. The main attaching portion further has a first opening to the first half circle and a second opening to the receiving rail recess. The first opening being in an opposite direction than the second opening. The second opening to the receiving rail recess defined by first and second retaining ridges that are configured to retain a mounting rail resting within the receiving rail recess. The main attaching portion further has an extended portion that separates the first half circle from the second half circle by a select distance. The second attaching portion has a second half circle. The second half circle is configured to form a full circle with the first half circle of the main attaching portion when the second main attaching portion is coupled to the main attaching portion.

In yet another embodiment, an attaching system is provided. The attaching system includes an attaching ring, a mounting rail and a threaded attaching member. The attaching ring includes a weapon attaching portion, a retaining portion and an extending portion. The weapon attaching portion is configured to attach to a weapon. The retaining portion is configured to receive and hold a mounting rail. The retaining portion includes a retaining aperture. The extended portion is coupled between the weapon attaching portion and the retaining portion. The extending portion has a select length to space the weapon attaching portion from the retaining portion a select distance. The mounting rail is configured to be received in the retaining portion. The mounting rail has a threaded recess. The threaded attaching member is configured to pass through the retaining aperture of the retaining portion and to threadably engage the threaded recess of the mounting rail.

In still another embodiment, a method of aiming a camera on a device mount coupled to a weapon is provided. The method comprising aiming a weapon at a target. Adjusting the zoom of the camera attached to the weapon and pivoting the camera on the device mount to center the focus of the camera on the target.

BRIEF DESCRIPTION OF THE DRAWINGS

The present invention can be more easily understood and further advantages and uses thereof more readily apparent, when considered in view of the detailed description and the following figures in which.

In accordance with common practice, the various described features are not drawn to scale but are drawn to emphasize specific features relevant to the present invention. Reference characters denote like elements throughout Figures and text.

DETAILED DESCRIPTION

In the following detailed description, reference is made to the accompanying drawings, which form a part hereof, and in which is shown by way of illustration specific embodiments in which the inventions may be practiced. These embodiments are described in sufficient detail to enable those skilled in the art to practice the invention, and it is to be understood that other embodiments may be utilized and that logical, mechanical and electrical changes may be made without departing from the spirit and scope of the present invention. The following detailed description is, therefore, not to be taken in a limiting sense, and the scope of the present invention is defined only by the claims and equivalents thereof.

Figure 1:
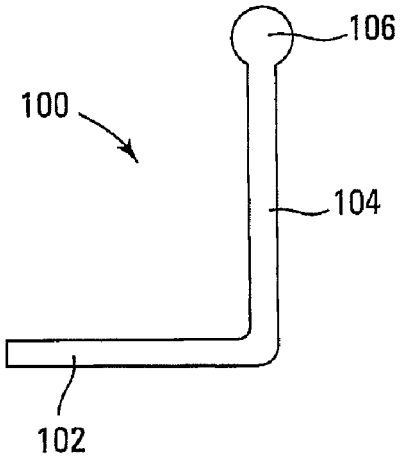
FIG. 1 is a side view of a device mount.
Figure 2:
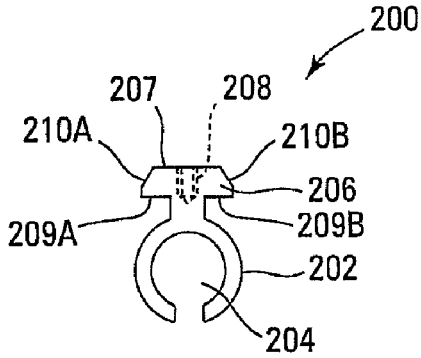
FIG. 2 is a side view of a stabilizing tube of one embodiment of the present invention.

Embodiments of the present invention provide a device mount system for mounting a device to a weapon. The device mount system includes a device mount (such as that disclosed in the '127 application that was herein incorporated by reference), a stabilizing tube and an attaching ring. Referring to FIG. 1, a side view of a device mount is illustrated. The device mount 100 includes a support plate 102, a side plate 104 and a bias portion 106. A side view of a stabilizing tube 200 of one embodiment of the present invention is illustrated in FIG. 2. This stabilizing tube 200 includes a tube portion 202. The tube portion 202 forms a receiving aperture 204. The bias potion 106 of the device mount 100 is received in the receiving aperture 204. The stabilizing tube also includes a mounting rail 206. The mounting rail 206 in this embodiment includes angled surfaces 210A and 210B that are beveled at a select angel in relation to a first engaging surface 207 and a second engaging surfaces 209A and 209B. As illustrated the first engaging surface 207 is position at an opposite end of the mounting rail 206 as the second engaging surfaces 210A and 210B. Moreover, the first and second angled surfaces 210A and 210B are between the first and second engaging surfaces 207, 209A and 209B. Further illustrated in FIG. 3 is a threaded recess 208.

Figure 3:
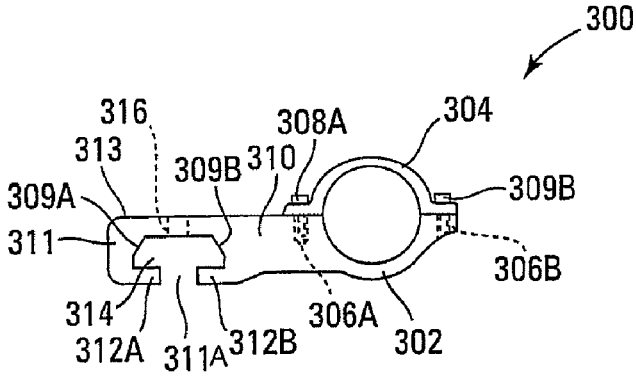
FIG. 3 is a side view of an attaching ring of one embodiment of the present invention.
Figure 5:
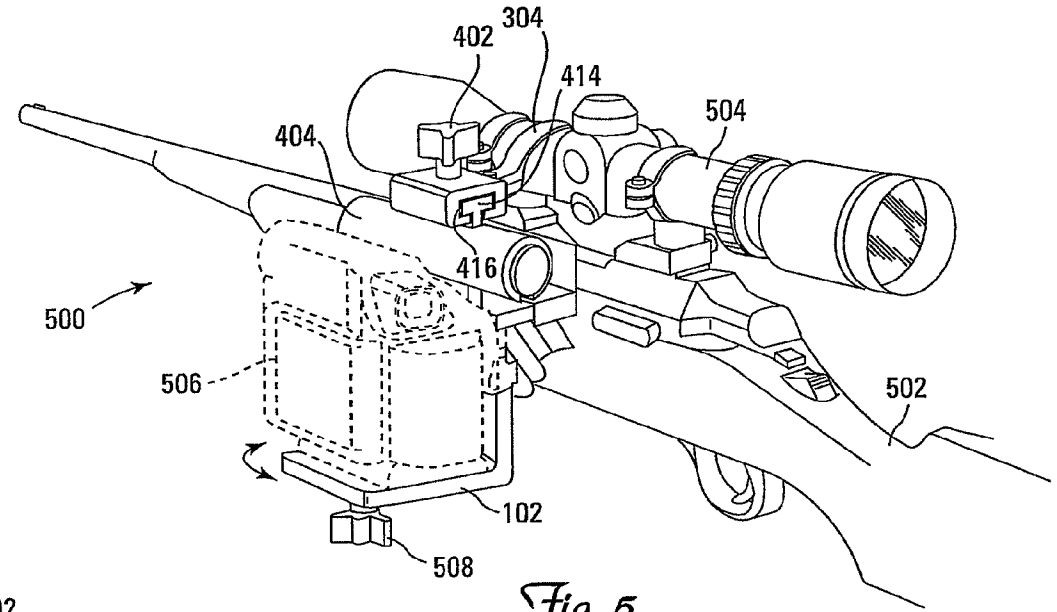
FIG. 5 is a perspective view of device mounted to a weapon using a device mount system of one embodiment of the present invention.

Referring to FIG. 3, a side view of an attaching ring 300 of one embodiment of the present invention is illustrated. The attaching ring 300 includes a main attaching portion 302, a secondary attaching portion 304 (or second attaching portion), an extended portion 310 and a stabilizer retaining portion 311. The secondary attaching portion 304 is selectively attached to the main attaching portion 302 via threaded attaching members 308A and 308B and threaded recesses 306A and 306B. In particular, in the embodiment of FIG. 3, a section if the main attaching portion 302 is in the form of a half circle and the secondary attaching portion 304 is also in the form of a half circle. When the secondary attaching portion 304 is attached to the main attaching portion 302 a full circle is formed. As illustrated in FIG. 5, the main attaching portion 302 and the secondary attaching portion 304 can be couple around a portion of the weapon 502 such as a scope 504. Referring back to FIG. 3, the stabilizer retaining portion 311 includes a receiving rail recess 314. The mounting rail 206 of the stabilizing tube 200 is selectively received in the receiving rail recess 314. When the mounting rail 206 is first placed in the recess 314, first and second retaining ridges 312A and 312B retain the mounting rail 206 within the receiving recess 314.

The retaining portion 311 of the attaching ring 300 further includes an opening 311A to the receiving rail recess 314 and an aperture 316. As illustrated, the aperture 316 extends from a surface 313 of the retaining portion 311 to the receiving rail recess from an opposite direction than the opening 311A to the receiving rail recess 314. A threaded attaching member is placed through aperture 316 of the attaching ring 300 and threadably engaged with the threaded recess 208 of the stabilizing tube 200. This forces the first and second angled surfaces 210A and 210B of the mounting rail 206 against respective first and second receiving surfaces 309A and 309B in the receiving rail recess 314 of the attaching ring 300 to lock the stabilizing tube 200 to the attaching ring 300. As illustrated in FIG. 3, the extended portion separates a weapon attaching portion formed by the main attaching portion 302 and the secondary attaching portion 304 and the retaining portion by a select distance. The select distance is determined by how far it is desired to have a device (such as a camera, rangefinder, etc) from the weapon.

Figure 4:
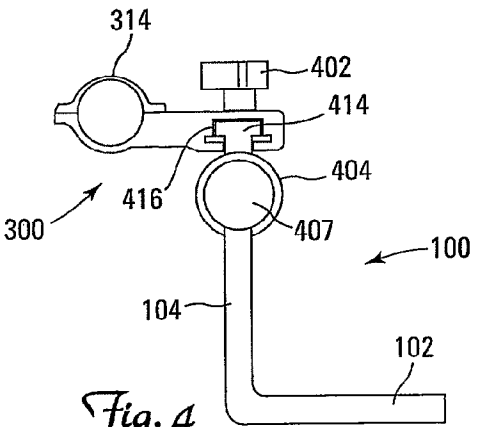
FIG. 4 is a side view of attaching ring attached to a device mount of one embodiment of the present invention.

FIG. 4 illustrates a side view of a stabilizing ring 300 attached to a device mount of one embodiment of the present invention. The mounting rail 414 of the stabilizing tube 404 is received in a receiving rail recess 416 of the attaching ring 300. As illustrated the shape of the mounting rail 414 and the receiving rail recess 416 are different than those of FIGS. 2 and 3. Accordingly, different shapes can be used and the present invention is not limited to a specific shape. The threaded attaching member 402 is a threaded thumb screw 402. The threaded thumb screw 402 threadably engages a threaded recess in the mounting rail 414 of the stabilizing tube 404 similar to the threaded recess 208 in the mounting rail 206 of the stabilizing tube 200 of FIG. 2. FIG. 4, also illustrates an end cap 407. The end cap is used to retain biasing members described in the incorporated '127 application.

FIG. 5 is a perspective view of a device mount system 500 of one embodiment attached to a weapon 502. The weapon 502 in this case is a firearm 502 such as a rifle and the device mount system 500 is attached to the firearm via scope 504. As illustrated, the secondary attaching portion 304 of the attaching ring is positioned around a top portion of the scope 504 attached to the weapon 502. The main attaching portion of the attaching ring is positioned around a lower portion of the scope 504 and attached to the secondary portion via threaded attaching members 308A and 308B as illustrated in FIG. 3. As illustrated in FIG. 5, the mounting rail 414 is received in the receiving rail recess 416 of the attaching ring and is locked in place by thumb screw 402 as described above. A device 506, such as a camera, is positioned on the support plate 102 of the device mount 100. A second thumb screw 508 is used to connect the device 506 to the support plate 102 of the device mount.

In one embodiment of the present invention, the device mount system 500 centers the weight of the device mount 100 about the connection of the attaching ring 300 to the mounting rail 414. This helps center the weight of the weapon in use as well as helps maintains a level of balance in a vertical direction while filming with a video camera attached to the device mount 100. To further the level of balance during filming, the camera 506 can be positioned in select locations in relation to the support plate 102 of the device mount. Further as illustrated in FIG. 5, the device mount system 500 of this embodiment places a camera lens of a camera 506 mounted to the device mount 100 in a position that is approximately level with the barrel of the weapon. This helps position the lens of the camera to capture the target even when the target is at different distances to the camera. Hence even at greater distances to targets where the weapon barrel has to be raised, the camera will still capture the target. Although, in some instances an adjustment with of the zoom of the camera might also be needed.

Figure 6:
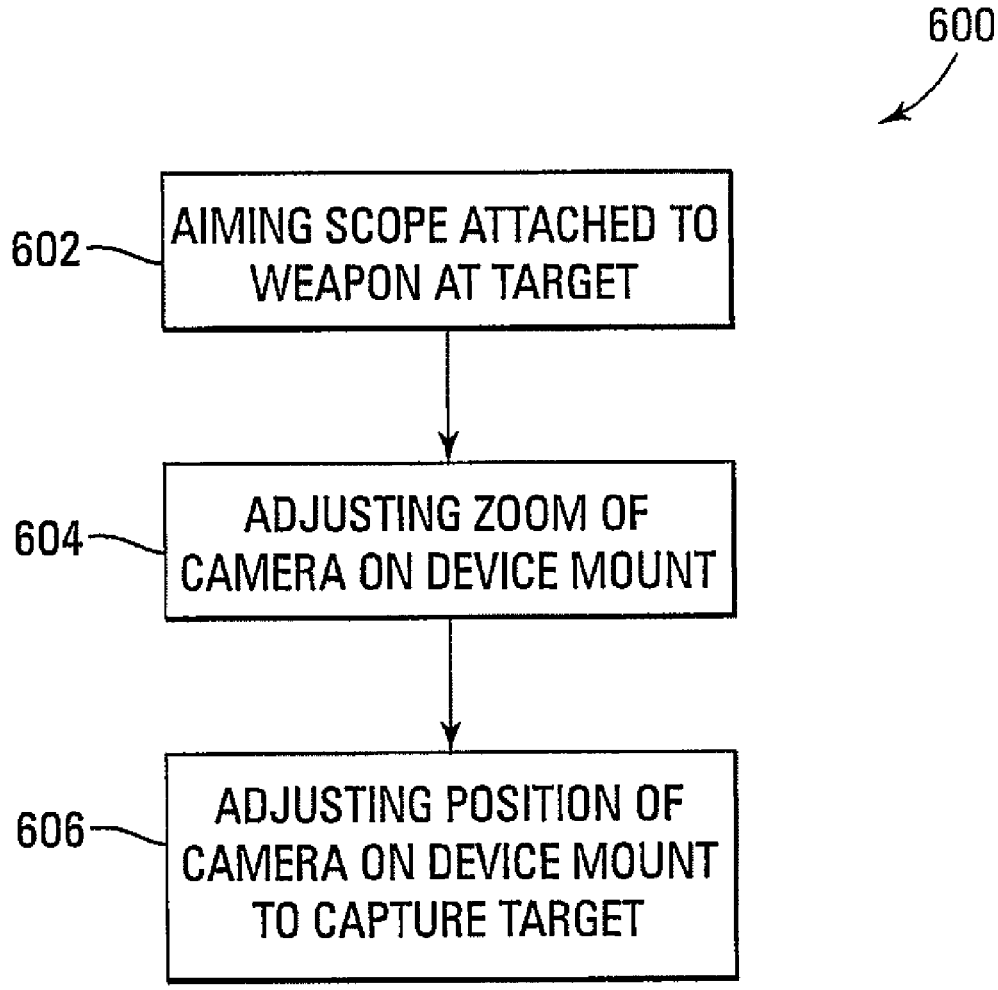
FIG. 6 is an aiming flow diagram of one embodiment of the present invention.

Referring to FIG. 6, an aiming flow diagram 600 describing one method of aligning a camera mounted to a device mount, such as shown in FIG. 5, to record a hunt is illustrated. As illustrated, a camera attached to the weapon via scope mount is aimed at the target (602). The zoom of the camera is then adjusted (640). Adjusting the zoom is dependant on the distance the target is from the weapon. Once the zoom is adjusted, the camera may need to be rotated on the support plate to center the target in the cameras field of view (102). In particular, referring to FIG. 5, the camera 506, is coupled to the support plate 102 of the device mount 100 via thumb screw 508. In this embodiment as illustrated, the camera 506 pivots about the thumb screw connection. Hence, the camera 506 can be rotated in relation to the support plate in a horizontal direction so its aim can be adjusted. Therefore, the aim of the camera can be adjusted to account for the distance to the target and the zoom of the camera lens. For example, if the target is at a shorter distance to the camera, the camera may need to be pivoted to the right to capture the image of the target and if the target is at a great distance from the camera, the camera 506 may need to be pivoted to the left to capture the image of the target.

Although specific embodiments have been illustrated and described herein, it will be appreciated by those of ordinary skill in the art that any arrangement, which is calculated to achieve the same purpose, may be substituted for the specific embodiment shown. This application is intended to cover any adaptations or variations of the present invention. Therefore, it is manifestly intended that this invention be limited only by the claims and the equivalents thereof.

The invention claimed is:

1. An attaching system comprising:

an attaching ring including, a weapon attaching portion configured to attach to a weapon, the weapon attaching portion including a bottom semi-circle and a top semi-circle, the bottom and top semi-circles forming a full circle, a retaining portion configured to receive and hold a mounting rail, the retaining portion having a rail receiving recess and a retaining aperture extending vertically through the rail receiving recess, and an extended portion extending horizontally between the weapon attaching portion and the retaining portion, the extending portion having a select length to space the weapon attaching portion horizontally apart from the retaining portion a select distance;

the mounting rail configured to be received in the retaining portion, the mounting rail having a threaded surface;

a threaded attaching member configured to pass through the retaining aperture of the retaining portion and to threadably engage the threaded recess of the mounting rail; and a device mount coupled to the mounting rail, wherein the device mount has a weight that is centered about the connection made by the attaching ring to the mounting rail.

2. The attaching system of claim 1, wherein the bottom semi-circle and the top semi-circle form a full circle that surrounds a scope attached to the weapon.

3. The attaching system of claim 1, wherein the device mount places a lens of a camera mounted thereon at a same level as a barrel of the weapon.

4. The attaching system of claim 1, wherein the retaining portion further includes:

a first retaining ridge; and a second retaining ridge, wherein the first and the second retaining ridge are configured to hold the mounting rail in the receiving recess when the mounting rail is received in the receiving rail recess.

5. The attaching system of claim 1, wherein the mounting rail has at least one surface configured to lock into a surface in the receiving rail recess of the retaining portion when the threaded attaching member threadably engages the threaded recess of the mounting rail.

6. An attaching system comprising:

an attaching ring including, a weapon attaching portion configured to attach to a weapon, a retaining portion configured to receive and hold a mounting rail, the retaining portion having a retaining aperture, and an extended portion coupled between the weapon attaching portion and the retaining portion, the extending portion having a select length to space the weapon attaching portion from the retaining portion a select distance;

the mounting rail configured to be received in the retaining portion, the mounting rail having a threaded recess;

a threaded attaching member configured to pass through the retaining aperture of the retaining portion and to threadably engage the threaded recess of the mounting rail; and a device mount coupled the mounting rail, wherein the device mount places a lens of a camera mounted thereon at a same level as a barrel of the weapon.

7. An attaching system comprising:

an attaching ring including, a weapon attaching portion configured to attach to a weapon, the weapon attaching portion including a bottom semi-circle and a top semi-circle, the bottom and top semi-circles forming a full circle, a retaining portion configured to receive and hold a mounting rail, the retaining portion having a rail receiving recess and a retaining aperture extending vertically through the rail receiving recess, and an extended portion extending horizontally between the weapon attaching portion and the retaining portion, the extending portion having a select length to space the weapon attaching portion horizontally apart from the retaining portion a select distance;

the mounting rail configured to be received in the retaining portion, the mounting rail having a threaded surface;

a threaded attaching member configured to pass through the retaining aperture of the retaining portion and to threadably engage the threaded recess of the mounting rail; and a device mount coupled to the mounting rail, wherein the device mount places a lens of a camera mounted thereon at a same level as a barrel of the weapon.

8. The attaching system of claim 7, wherein the bottom semi-circle and the top semi-circle form a full circle that surrounds a scope attached to the weapon.

9. The attaching system of claim 7, wherein the device mount has a weight that is centered about the connection made by the attaching ring to the mounting rail.

10. The attaching system of claim 7, wherein the retaining portion further includes:

a first retaining ridge; and a second retaining ridge, wherein the first and the second retaining ridge are configured to hold the mounting rail in the receiving recess when the mounting rail is received in the receiving rail recess.

11. The attaching system of claim 7, wherein the mounting rail has at least one surface configured to lock into a surface in the receiving rail recess of the retaining portion when the threaded attaching member threadably engages the threaded recess of the mounting rail.

* * * * *